US006888440B2

(12) United States Patent
Ackermann

(10) Patent No.: US 6,888,440 B2
(45) Date of Patent: May 3, 2005

(54) FUSE WITH FUSE LINK COATING

(75) Inventor: John Marvin Ackermann, Belleville, IL (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 10/672,840

(22) Filed: Sep. 26, 2003

(65) Prior Publication Data

US 2004/0085179 A1 May 6, 2004

Related U.S. Application Data

(62) Division of application No. 10/302,549, filed on Nov. 21, 2002, now Pat. No. 6,664,886, which is a division of application No. 09/549,143, filed on Apr. 13, 2000, now Pat. No. 6,507,265.

(60) Provisional application No. 60/131,550, filed on Apr. 29, 1999.

(51) Int. Cl.[7] ..... H01H 85/06; H01H 85/08; H01H 85/38

(52) U.S. Cl. ..... 337/296; 337/280; 337/273; 337/234; 29/623

(58) Field of Search ..... 337/159, 163, 337/166, 234, 236, 238, 239, 260, 270, 273–282, 296; 29/623

(56) References Cited

U.S. PATENT DOCUMENTS

| | | | | | |
|---|---|---|---|---|---|
| 3,601,737 | A | * | 8/1971 | Baird et al. | 337/159 |
| 4,563,809 | A | * | 1/1986 | Reeder | 29/623 |
| 5,280,261 | A | * | 1/1994 | Mollet | 337/158 |
| 6,160,471 | A | * | 12/2000 | Rybka et al. | 337/278 |

* cited by examiner

*Primary Examiner*—Anatoly Vortman
(74) *Attorney, Agent, or Firm*—Armstrong Teasdale LLP

(57) ABSTRACT

A fuse that includes an arc energy reducing coating to reduce arc energy during a short-circuit and/or a full voltage overload current interrupt is described. The fuse includes end conductor elements, and at least one fuse element secured between and making electrical contact with the end conductor elements. An elongate fuse housing, having a passageway extending longitudinally through the housing, extends between the end conductor elements. The fuse element extends through the housing passageway. An arc energy reducing coating at least partially coats each end portion of the fuse element.

11 Claims, 3 Drawing Sheets

FUSE WITH FUSE LINK COATING

CROSS REFERENCE TO RELATED APPLICATIONS

This application is a divisional application of U.S. application Ser. No. 10/302,549 filed Nov. 21, 2002, now U.S. Pat. No. 6,664,886 which is a divisional application of U.S. application Ser. No. 09/549,143 filed Apr. 13, 2000, now issued U.S. Pat. No. 6,507,265, which claims the benefit of U.S. Provisional Application No. 60/131,550 filed Apr. 29, 1999.

BACKGROUND OF THE INVENTION

This invention relates generally to fuses for interrupting the flow of current through an electrical circuit upon predetermined overload conditions and, more particularly, to fuses with direct current and alternating current arc interrupting capability.

As is well known, fuses are used in electrical circuits to interrupt the flow of current when there is a short-circuit and/or a full voltage overload current event. Fuses typically include one or more fuse elements electrically connected to two end conductors located at opposing ends of the fuse. In the event of a short circuit and/or a full voltage overload, the temperature of the fuse element increases until a portion of the element melts and breaks. The break in the fuse element typically causes an electric arc to be established.

Sand is typically used to fill the fuse cartridge to surround the fuse elements to assist in quenching an arc. U.S. Pat. No. 4,656,453 describes cartridge fuses that include end plugs that are used for arc quenching. The fuse element passes through the end plugs adjacent to the end conductors. U.S. Pat. No. 5,280,261 describes a current limiting fuse that includes a short circuit strip that has a plurality of 90 degree angle bends along the length of the strip. The multiple bends in the fuse strip cause the strip to contact or come in close proximity of the inside wall of the fuse body. When a short-circuit arc occurs the fuse strip material burns towards the fuse wall creating an interaction with the fuse wall and an increase in pressure, which extinguishes the arc. However, even with the above noted examples of arc quenching, these fuses may not interrupt the circuit satisfactorily.

It would be desirable to provide a fuse that includes arc quenching capabilities during a short-circuit and/or a full voltage overload current interrupt event. It would also be desirable to provide a fuse that reduces arc energy during a short-circuit and/or a full voltage overload current interrupt event.

BRIEF SUMMARY OF THE INVENTION

In an exemplary embodiment of the invention, a fuse includes an arc energy absorbing coating to reduce arc energy during a short-circuit and/or a full voltage overload current interrupt. The fuse includes end conductor elements, and at least one fuse element secured between and making electrical contact with the end conductor elements. An elongate fuse housing, having a passageway extending longitudinally through the housing, extends between the end conductor elements. The fuse element extends through the housing passageway. The fuse includes an arc energy absorbing coating which at least partially coats each end portion of the fuse element.

Prior to assembly of the fuse, an arc energy absorbing coating is applied to the end portions of the fuse element.

The fuse element is mechanically and electrically attached to the end conductor elements, typically by soldering, welding or brazing. The end conductor elements are positioned over the ends of the housing and crimped into receiving grooves in the fuse housing. The housing passageway is filled with a filler material, typically prior to positioning the second end conductor element at the end of the housing.

The above described fuse provides arc quenching capabilities during a short-circuit and/or a full voltage overload current interrupt event. The fuse also reduces arc energy during a short-circuit and/or a full voltage overload current interrupt event.

DETAILED DESCRIPTION OF THE INVENTION

Figure 1:
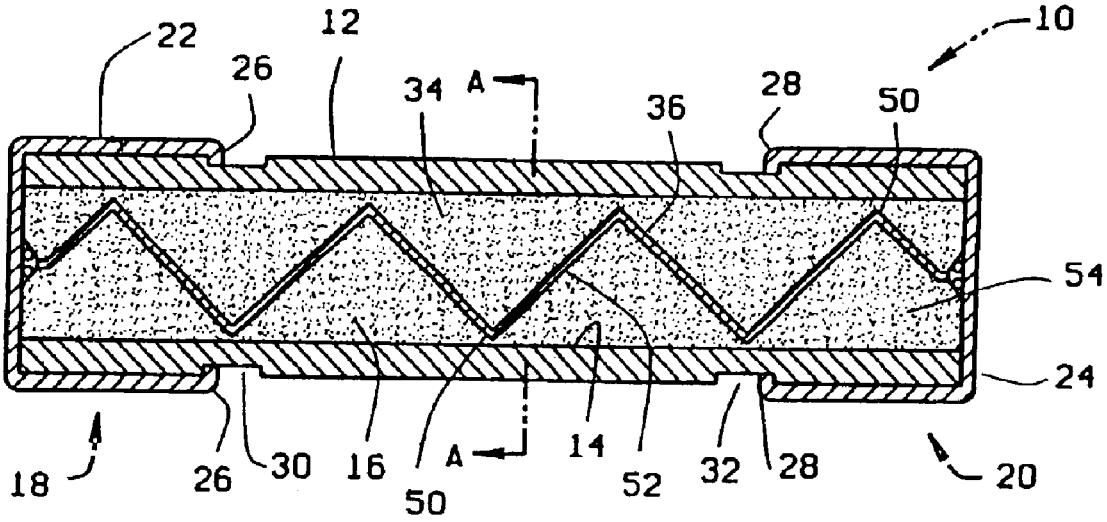
FIG. 1 is a sectional side view of a fuse in accordance with an embodiment of the present invention.
Figure 2:
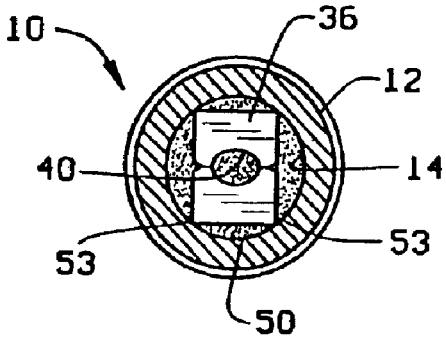
FIG. 2 is a cross-sectional view along line A—A of the fuse shown in FIG. 1.

FIG. 1 is a sectional side view of a fuse 10, in accordance with an embodiment of the present invention, and FIG. 2 is a cross sectional view of fuse 10. Referring to FIGS. 1 and 2, fuse 10 includes an elongate housing 12 fabricated from an insulating material. Fuse housing 12 includes an inside surface 14 defining a passageway 16 extending from a first end 18 to a second end 20 of fuse housing 12. Fuse housing 12 may be any suitable shape, for example, tubular, rectangular, octangular, or hexangular. In the embodiment shown in FIG. 1, fuse housing 12 has a tubular shape.

A first conductive end cap 22 is positioned over first end 18 of housing 12, and a second conductive end cap 24 is positioned over second end 20 of housing 12. End caps 22 and 24 have the same cross sectional shape as housing 12. End caps 22 and 24 are coupled to fuse housing 12 by flanges 26 and 28 respectively. Housing 12 includes grooves 30 and 32 which receive flanges 26 and 28. In an alternative embodiment, housing 12 does not include grooves 30, 32, and end caps 22 and 24 are crimped directly onto housing 12. End caps 22 and 24 and inside surface 14 of housing 12 form a chamber 34 inside fuse 10.

A fuse element or strip 36 extends through passageway 16. Particularly, fuse strip 36 extends between end caps 22 and 24, and is electrically connected, e.g., soldered, welded, or brazed, to end caps 22 and 24. Fuse strip 36 is a strip of conductive metal. Fuse strip 36 may be fabricated from any suitable conductive metal, for example silver, gold, copper, aluminum, and the like, In one embodiment, fuse strip 36 is fabricated from silver.

Figure 3:
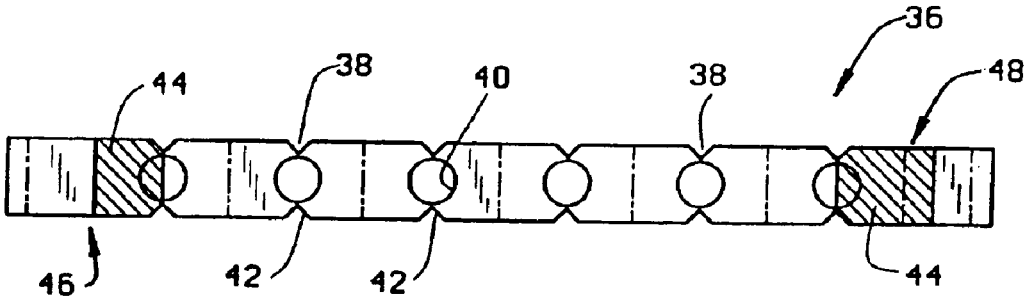
FIG. 3 is a top view of a fuse strip housed within the fuse shown in FIG. 1.

As shown in FIG. 3, fuse strip 36 includes a plurality of weak spots 38 located along the length of strip 36. Each weak spot 38 includes a circular opening 40 and opposing notches 42 adjacent opening 40. In alternative embodiments, weak spots 38 are formed from alternate shaped openings, for example, squares, ovals, triangles, and the like. Also, in alternate embodiments, weak spots 38 are formed by a plurality of grooves extending across fuse strip 36.

To reduce arc energy during a short-circuit and/or a full voltage overload current interrupt event, an arc energy absorbing coating 44 at least partially coats a first end portion 46 and a second end portion 48 of fuse strip 36. Arc energy absorbing coating 44 at least partially coats both sides of end portions 46 and 48 and extends partially around openings 40 adjacent fuse end portions 46 and 48. For optimal performance, openings 40 are substantially free of coating 44. In an alternative embodiment, arc energy absorbing coating 44 at least partially coats one side of end portions 46 and 48. Typically, arc energy absorbing coating 44 has a dry film thickness on each side of fuse strip 36 of between about 0.01 inch to about 0.30 inch, more typically between about 0.05 inch to about 0.10 inch. However, thinner and thicker film thicknesses may be used. Arc energy absorbing coating 44 film thicknesses lower than 0.01 inch may not provide sufficient arc suppression, especially in high current rated fuses. In one embodiment, arc energy absorbing coating 44 coats an area on each side of end portions 46 and 48 of about 0.260 inches by about 0.140 inches, and has a film thickness of about 0.08 inch on each side.

Arc energy absorbing coating 44 may be, for example, an organo-silicone coating or an epoxy coating. Suitable organo-silicone coatings include, but are not limited to, alkoxy silicone coatings, for example methoxy silicone and acetoxy silicone coatings. Examples of alkoxy silicone coatings include NUVA-SIL 5083, NUVA-SIL 5088, and NUVA-SIL 5091 commercially available from Loctite Corporation, Rocky Hill, Conn. A suitable epoxy coating includes, but is not limited to NORDBAK 7459-9950 commercially available from Loctite Corporation. Coating 44 is applied to fuse strip end portions 46, 48 and cured according to known methods and techniques, including, but not limited to UV curing processes, heat curing processes, and moisture curing processes such as atmospheric or humidity chamber curing processes in accordance with the particular coating selected.

Referring again to FIGS. 1 and 2, fuse strip 36 includes a plurality of bends 50 spaced longitudinally along strip 36. Bends 50 divide fuse strip 36 into a plurality of substantially straight segments 52. Each bend 50 has an angle of about 45 degrees to about 120 degrees, typically from about 60 degrees to about 90 degrees. Bends 50 and straight segments 52 are configured to cause fuse strip 36 to contact inside surface 14 of housing 12 at contact points 53.

Chamber 34 is filled with filler material 54. Suitable filler materials 54 include, for example, silica sand, powdered gypsum, inert gasses, and the like.

Prior to assembly of fuse 10, arc energy absorbing coating 44 is applied to fuse strip 36. Typically, arc energy absorbing coating 44 is applied before bends 50 are formed in strip 36. However, bends 50 may be formed in fuse strip 36 before applying arc energy absorbing coating 44.

Fuse strip 36 is mechanically and electrically attached to end caps 22 and 24, typically by soldering fuse strip 36 to each end cap 22 and 24. Typically discs of solder are placed inside end caps 22 and 24 before fuse strip 36 is inserted inside end caps 22 and 24. Heat is then applied to melt the solder, thereby soldering fuse strip 36 to end caps 22 and 24. In alternative embodiments, fuse strip 36 is welded or brazed to end caps 22 and 24. First end cap 22 is positioned over first end 18 of housing 12 and second end cap 24 is positioned over second end 20 of housing 12. Flanges 26 and 28 are crimped into grooves 30 and 32 respectively to secure end caps 22 and 24 to housing 12.

Chamber 34 is filled with filler material 54, typically, prior to second end cap 24 being positioned over second end 20 of housing 12.

The above described fuse 10 includes bends 50 which cause fuse strip 36 to contact housing 12 at contact points 53, filler material 54, and arc energy absorbing coating 44 which assist in arc quenching during a short-circuit and/or a full voltage overload current interrupt event. Also, because of arc energy absorbing coating 44, fuse 10 has reduced arc energy during the short-circuit or full voltage overload current interrupt event.

Figure 4:
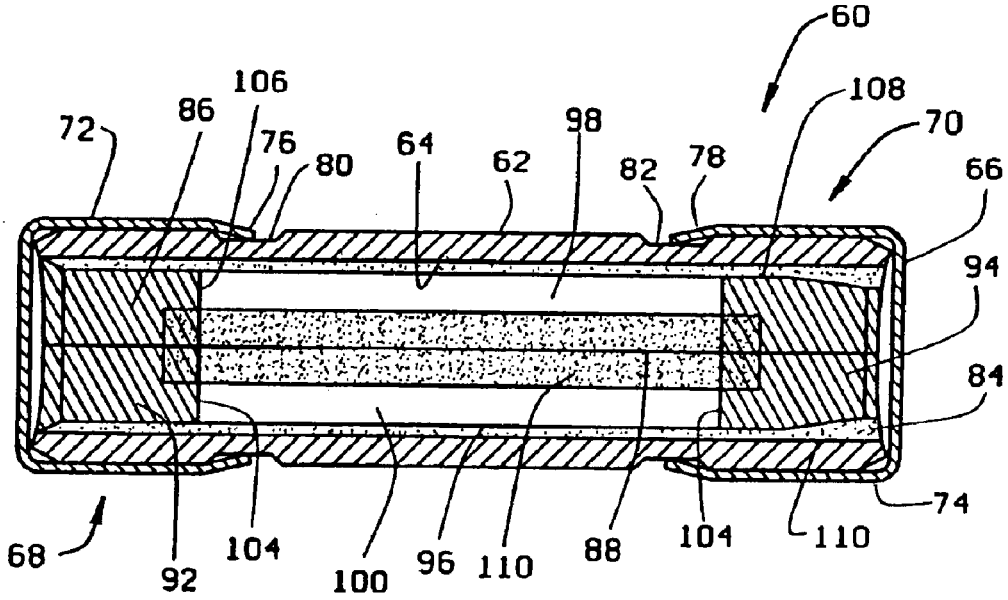
FIG. 4 is a sectional side view of a fuse in accordance with another embodiment of the present invention.

FIG. 4 is a sectional side view of a fuse 60 in accordance with another embodiment of the present invention. Similar to fuse 10 described above, fuse 60 includes an elongate housing 62 fabricated from an insulating material. Fuse housing 62 includes an inside surface 64 defining a passageway 66 extending from a first end 68 to a second end 70 of fuse housing 62.

A first conductive end cap 72 is positioned over first end 68 of housing 62, and a second conductive end cap 74 is positioned over second end 70 of housing 62. End caps 72 and 74 have the same cross sectional shape as housing 62. End caps 72 and 74 are coupled to fuse housing 62 by flanges 76 and 78 respectively. Housing 62 includes grooves 80 and 82 which receive flanges 76 and 78 respectively. In an alternative embodiment, housing 62 does not include grooves, and end caps 72 and 74 are crimped directly onto housing 62. End caps 72 and 74 and inside surface 64 of housing 62 form a chamber 84 inside fuse 60.

Figure 5:
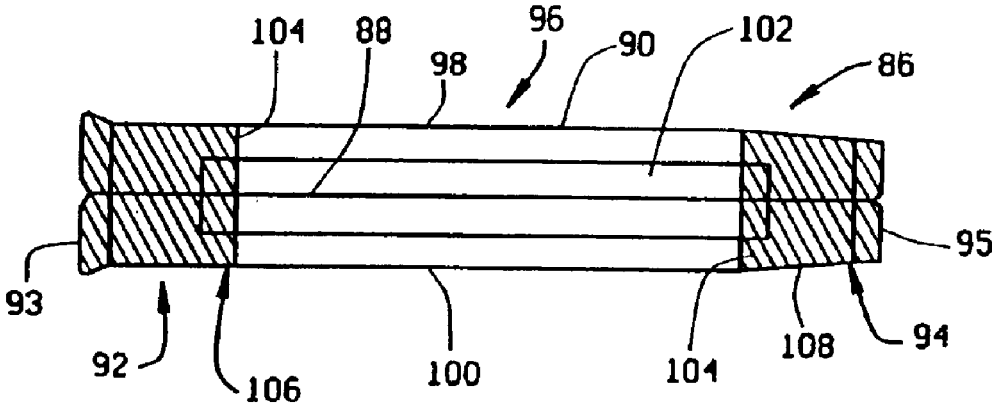
FIG. 5 is a top view of a fuse element housed within the fuse shown in FIG. 4.

A fuse element assembly 86 extends through passageway 66. Particularly, fuse element assembly 86 extends between end caps 72 and 74. Fuse element assembly 86 is electrically connected to end caps 72 and 74. Referring also to FIG. 5, fuse element assembly 86 includes a fuse wire 88 and a substantially flat nonconductive bridge 90. Bridge 90 includes a first end portion 92, a second end portion 94, and an elongate central portion 96. Elongate central portion 96 includes first and second side sections 98 and 100 extending between first and second end portions 92 and 94 of bridge 90. First and second side sections 98 and 100 define an elongate opening 102 in bridge 90. Fuse wire 88 extends between and is coupled to first and second end portions 92 and 94 so that fuse wire 88 makes electrical contact with first and second end caps 72 and 74. Fuse wire 88 extends through elongate opening 102 in bridge 90.

An arc energy absorbing coating 104 at least partially coats fuse wire 88 and bridge 90 at a first location 106 and at a second, separate, location 108. At first location 106, arc energy absorbing coating 104 coats bridge first end portion 92 and wire 88 at end portion 92 and extending into bridge elongate opening 102. At second location 108, arc energy absorbing coating 104 coats bridge second end portion 94 and wire 88 at end portion 92 and extending into bridge elongate opening 102. Bridge first end surface 93 and second end surface 95 are kept free of arc energy absorbing coating 104 to permit an electrical connection between fuse wire 88 and end caps 72 and 74. Additionally, chamber 84 is filled with a filler material 110 similar to filler material 54 described above.

Figure 6:
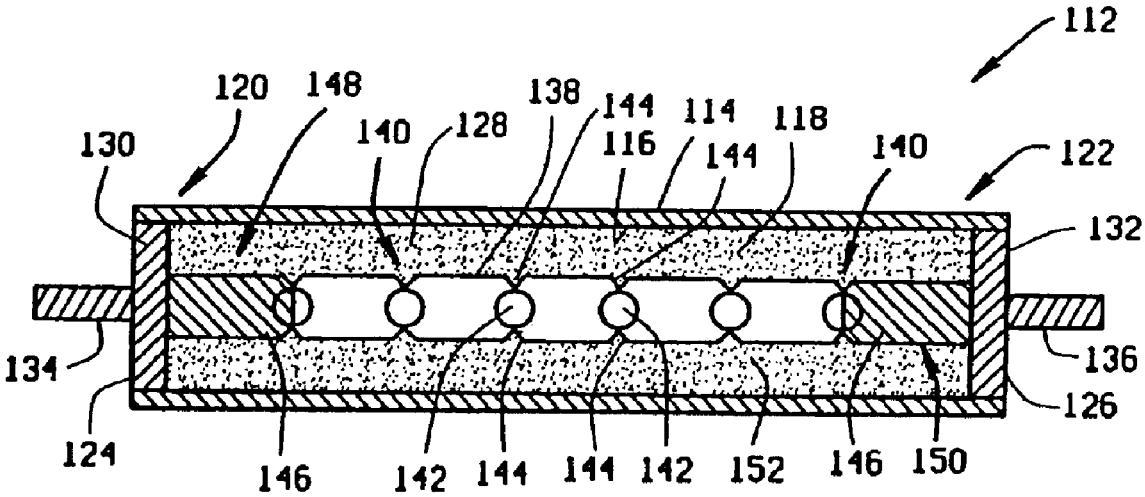
FIG. 6 is a sectional side view of a fuse in accordance with still another embodiment of the present invention.

FIG. 6 shows a fuse 112 in accordance with another embodiment of the present invention. Similar to fuse 10 described above, fuse 112 includes an elongate housing 114 fabricated from an insulating material. Fuse housing 114 includes an inside surface 116 defining a passageway 118 extending from a first end 120 to a second end 122 of fuse housing 114.

A first conductive terminal element 124 is coupled to first end 120 of housing 114, and a second conductive terminal element 126 is coupled to second end 122 of housing 114.

Terminal elements 124 and 126 include end plates 130 and 132 respectively. Elongate terminal blades 134 and 136 extend outward from end plates 130 and 132 respectively. Terminal elements 124 and 126 and inside surface 116 of housing 114 form a chamber 128 inside fuse 112.

A fuse element or strip 138 extends through passageway 118. Particularly, fuse strip 138 extends between terminal elements 124 and 126. Fuse strip 138 is electrically connected to terminal elements 124 and 126. Fuse strip 138 is a strip of conductive metal and may be fabricated from any suitable conductive metal as described above.

Fuse strip 138 includes a plurality of weak spots 140 located along the length of strip 138. Each weak spot 140 includes a circular opening 142 and two notches 144 adjacent opening 142. In alternative embodiments, weak spots 140 may be formed from alternate shaped openings, for example, squares, ovals, triangles, and the like. Also, weak spots 140 may be formed by a plurality of grooves extending across fuse strip 138.

To reduce arc energy during a short-circuit and/or a full voltage overload current interrupt event, an arc energy absorbing coating 146 at least partially coats a first end portion 148 and a second end portion 150 of fuse strip 138. Arc energy absorbing coating 146 at least partially coats both sides of end portions 148 and 150. In an alternative embodiment, arc energy absorbing coating 146 at least partially coats one side of end portions 148 and 150.

Chamber 128 is filled with a filler material 152. As described above, suitable filler materials 152 include, for example, silica sand, powdered gypsum, inert gasses, and the like.

In alternative embodiments, fuse 112 includes a plurality of laterally spaced fuse strips 138. Each fuse strip 138 includes arc energy coating 146 on at least one side of end portions 148 and 150.

While the invention has been described in terms of various specific embodiments, those skilled in the art will recognize that the invention can be practiced with modification within the spirit and scope of the claims.

What is claimed is:

1. A method of fabricating a fuse, the fuse including end conductor elements, a fuse element secured between and making electrical contact with the end conductor elements, an elongate fuse housing extending between the end conductor elements, and an arc energy absorbing coating at least partially coating a first and a second end portion of the fuse element, the housing comprising an inside surface defining a passageway extending longitudinally from a first end to a second end of the housing, the fuse element including a plurality of weak spots having a reduced cross sectional area, and the fuse element extending through the passageway, said method comprising:

applying the coating to the first and second end portions of the fuse element and incompletely covering at least one of the weak spots with the coating;

coupling the fuse element to the end conductor elements; and coupling the end conductor elements to the housing.

2. A method in accordance with claim 1 wherein said end conductor elements comprise a first end cap and a second end cap, each end cap comprising a flange, and said coupling the end conductor elements to the housing comprises:

positioning the first end cap over the first end of the housing;

positioning the second end cap over the second end of the housing; and crimping the flanges to engage the housing.

3. A method in accordance with claim 2 wherein said fuse element comprises at least one strip of conductive metal, each strip comprising a plurality of weak spots extending the length of the strip and a silicone coating at least partially coating a first location adjacent a first end of the strip, and at a second, separate, location adjacent a second end of the strip, and said coupling the fuse element to the end conductor elements comprises:

soldering the first end of the at least one strip of conductive metal to the first end cap; and soldering the second end of the at least one strip of conductive metal to the second end cap.

4. A method in accordance with claim 3 wherein said fuse element includes a strip of conductive metal and said method further comprises forming a plurality of bends in the strip to form a plurality of straight segments.

5. A method in accordance with claim 1 wherein said end conductor elements include first and second terminal elements, said method further comprising closing the passageway at either end with the end conductor elements.

6. A method in accordance with claim 1 wherein the fuse element includes opposite ends and a plurality of weak spots between the opposite ends, said applying the coating to the first and second end portions of the fuse element comprises applying the coating between the ends of the fuse element and a portion of a first weak spot adjacent each of the ends such that the fuse element is free of coating therebetween.

7. A method in accordance with claim 1 wherein the fuse element is a flat strip having opposite sides, said applying the coating to the first and second end portions of the fuse element comprises applying the coating to each of the opposite sides.

8. A method of fabricating a fuse, the fuse including end conductor elements and a fuse element having first and second end portions, the fuse element including at least one weak spot adjacent one of said first and second end portions, the fuse element secured between and making electrical contact with the end conductor elements within a fuse housing, said method comprising:

applying an arc energy absorbing coating to the first and second end portions of the fuse element while incompletely covering the weak spot with the coating and leaving a center portion of the fuse element between the first and second end portions free from said coating;

positioning the fuse element within the housing; and electrically connecting the fuse element to the end conductor elements.

9. A method in accordance with claim 8 further comprising forming a plurality of bends in said fuse element.

10. A method in accordance with claim 8 wherein the fuse element is a strip having opposite, sides, said applying the coating to the first and second end portions of the fuse element while leaving a center portion of the fuse element between the first and second end portions free from said coating comprising coating both of the opposite sides of the fuse element at the end portions of the fuse element.

11. A method of fabricating a fuse, the fuse including end conductor elements, a fuse element secured between and making electrical contact with the end conductor elements, an elongate fuse housing extending between the end conductor elements, and an arc energy absorbing coating at least partially coating a first and a second end portion of the fuse element, the housing comprising an inside surface defining a passageway extending longitudinally from a first end to a second end of the housing, the fuse element extending through the passageway, said method comprising:

applying the coating to the first and second end portions of the fuse element;

coupling the fuse element to the end conductor elements;

coupling the end conductor elements to the housing;

wherein the fuse element includes a first end, a second end, and a plurality of weak spots having a reduced cross sectional area positioned between said first end and second end, said applying the coating to the first and second end portions of the fuse element comprises applying the coating between the first end and a respective one of said weak spots closest to the first end, and applying the coating between the second end and a respective one of said weak spots closest to the second end;

wherein said applying the coating between the first end of the fuse element and a respective one of said weak spots closest to the first end comprises applying the coating such that a first portion of the weak spot closest to the first end of the fuse element is covered with the coating and a second portion of the weak spot closest to the first end of the fuse element is uncovered by the coating, the second portion farther from the first end of the fuse element than the first portion; and said applying the coating between the second end of the fuse element and a respective one of said weak spots closest to the second end of the fuse element comprises applying the coating such that a first portion of the weak spot closest to the second end of the fuse element is covered with the coating and a second portion of the weak spot closest to the second end of the fuse element is uncovered by the coating, the second portion farther from the second end of the fuse element than the first portion.

* * * * *